US005263283A

United States Patent [19]

Rudolf et al.

[11] Patent Number: 5,263,283

[45] Date of Patent: Nov. 23, 1993

[54] PORTABLE POWER TOOL

[75] Inventors: Boris Rudolf, Stuttgart; Hans H. Rottmerhusen, Tellingstedt, both of Fed. Rep. of Germany

[73] Assignee: C. & E. Fein GmbH & Co., Stuttgart, Fed. Rep. of Germany

[21] Appl. No.: 906,743

[22] Filed: Jun. 30, 1992

[30] Foreign Application Priority Data

Jul. 5, 1991 [DE] Fed. Rep. of Germany ..... 4122320
Oct. 15, 1991 [DE] Fed. Rep. of Germany ..... 4134072
Oct. 23, 1991 [DE] Fed. Rep. of Germany ..... 4134887

[51] Int. Cl.[5] ..... B24B 23/02

[52] U.S. Cl. ..... 51/170 R; 51/168; 51/166 TS

[58] Field of Search ..... 51/166 TS, 168, 170 R, 51/170 PT

[56] References Cited

U.S. PATENT DOCUMENTS

Re. 33,335 9/1990 Gentischer et al. ..... 51/168
1,159,108 11/1915 Schwartz ..... 51/170 R
1,393,817 10/1921 Olson ..... 51/166 TS
2,213,432 9/1940 McCartney ..... 51/166 TS
4,237,659 12/1980 Welsch et al. ..... 51/168
4,779,382 10/1988 Rudolf et al. ..... 51/168
4,976,071 12/1990 Stäbler ..... 51/168
4,989,374 2/1991 Rudolf et al. ..... 51/168
5,058,909 10/1991 Rudolf et al. ..... 51/168

FOREIGN PATENT DOCUMENTS 0152564 8/1985 European Pat. Off. .
3405885 2/1984 Fed. Rep. of Germany .
2071567 9/1981 United Kingdom .

*Primary Examiner*—Bruce M. Kisliuk
*Assistant Examiner*—E. Morgan
*Attorney, Agent, or Firm*—Barry R. Lipsitz

[57] ABSTRACT

A portable power tool has, in order to drive a tool (12), a hollow spindle (14) to which the tool (12) can be fastened between two flanges (16, 18). The outer flange (16) is configured at the end of a clamping bolt (22) that is inserted through a central opening (17) of the tool (12) and projects at its other end out of the housing (42). The clamping bolt (22) can be non-rotatably secured at this end by means of a retaining element (20). For actuation, a clamping device (24) is provided, which can be moved, against the force of spring elements (26), between a clamped position in which the retaining element (20) is acted upon axially to clamp the tool (12), and a released position in which the tool is disengaged for manual changing. The spring elements (26) are arranged between an axial fixed stop (28) and an axially displaceable stop (FIG. 1).

20 Claims, 3 Drawing Sheets

Fig. 1
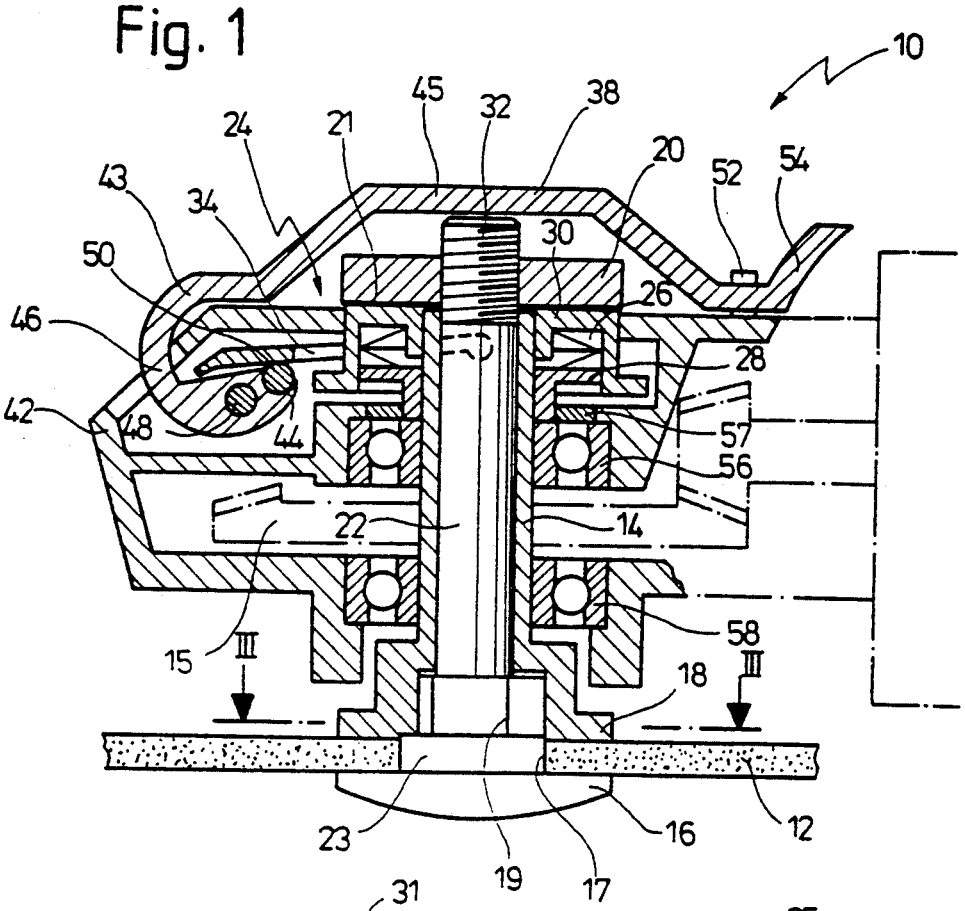
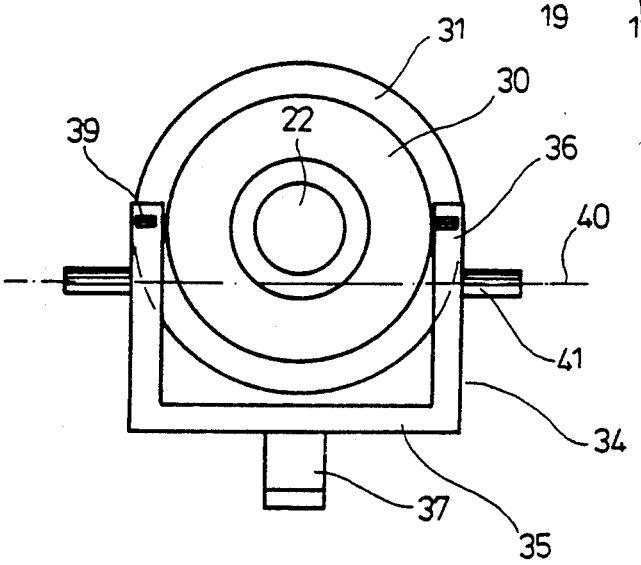
Fig. 2
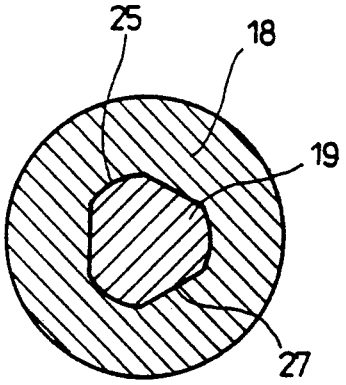
Fig. 3

PORTABLE POWER TOOL

The invention relates to a portable power tool, especially a right-angle grinder; with a motor to drive a tool by means of a right-angle drive train; with a hollow spindle at one end of which the tool can be fastened; with a clamping bolt arranged within the hollow spindle, by means of which the tool can be non-rotatably clamped; with a manually actuated clamping device which can be moved, against the force of spring elements, between a clamped position in which the tool is clamped in the axial direction, and a released position in which the tool is disengaged for manual changing.

DE 34 05 885 C1 discloses a right-angle grinder in which the grinding tool can be non-rotatably clamped by means of a quick-clamping device without the aid of an additional tool. The known right-angle grinder is driven by a motor via a right-angle drive train, by which a grinding spindle is driven. Arranged in an axially displaceable manner inside the grinding spindle, which is designed as a hollow spindle, is a clamping bolt at whose end nearest the grinding disk the grinding disk is accommodated between two flanges. The clamping bolt can be displaced axially, against the force of spring elements and by means of a manually actuated clamping device, between a clamped position and a released position. In the released position, the clamping bolt is displaced axially towards the grinding disk. This disengages the outer flange, which is screwed onto a threaded stem on the grinding-disk end of the clamping bolt, so that the latter can be unscrewed from the threaded stem, without the aid of a tool, in order to change the grinding disk.

After the grinding disk has been manually changed and the outer flange has been manually screwed onto the threaded stem, the clamping device is brought into the clamped position by rotating the clamping lever. This displaces the clamping bolt axially, so that under the action of the spring elements, the grinding disk is non-rotatably clamped by frictional engagement between the two flanges.

With the known arrangement, the fact that the grinding tool is fastened on the tool side by screwing the outer flange onto the threaded stem has proved to be disadvantageous, since the user can easily slip in the process, which can result in injury from the sharp grinding disk.

Moreover, the known arrangement is suitable only for clamping specific tools. Bent tools, steel wire brushes, cup wheels, and other special tools cannot easily be fastened; special additional tools or adapters are required.

The object underlying the invention is therefore that of creating a portable power tool in which it is easily possible to clamp various tools without additional contrivances, and in which the danger of injury is lessened.

In accordance with the present invention, this object is achieved by the fact that the retaining element is provided on the side of the clamping bolt facing away from the tool.

In this manner, any tool can be clamped between the two flanges without the aid of an additional tool. This also makes possible the use of bent tools, brush tools, etc., since the tool is simply clamped by frictional engagement between two flanges, with the outer flange being provided on the tool end of the clamping bolt.

Since the clamping bolt must simply be inserted through the central opening of the tool, and since no additional manipulation whatsoever at the tool end is required, the risk of injury is substantially reduced.

In a further embodiment of the invention, the retaining element is positively retained in the clamped position.

Since grinding disks inherently have a certain play, and since vibrations occur during grinding, a simple threaded joint might come loose. Positive retention ensures secure fastening of the tool for all applications, even when improperly used.

In a further embodiment of the invention, the displaceable stop is in the shape of a bushing, and is arranged coaxially on the hollow spindle.

In this embodiment the spring elements that on one side are braced against the fixed stop are surrounded on the other side by the bushing-shaped displaceable stop, so that the seat for the spring elements is simultaneously defined.

The retaining element can be designed as a tension nut that can be screwed onto a threaded portion of the clamping bolt.

After the clamping device has been brought into the released position, the tension nut can be screwed onto the threaded portion without the aid of a tool, after which the clamping device is brought into the clamped position, which clamps the tool non-rotatably. To change the tool, the clamping device is brought back into the released position. The tension nut can now be unscrewed from the threaded portion of the clamping bolt and the clamping bolt can be pulled out of the hollow spindle, so that the tool can be removed. After a new tool has been put in place, the clamping bolt is once again inserted through its central opening, and fastened at its other end by screwing on the tension nut. Then the clamping device is brought into the clamped position, whereby the tool is non-rotatably clamped between the two flanges, and simultaneously the tension nut is positively retained in the clamped position.

Positive retention can easily be achieved by the fact that the displaceable stop and the retaining element have end serrations, with which the retaining element is positively retained when resting on the displaceable stop.

Alternatively, the retaining element can be positively retained on the clamping bolt by a bayonet fastener.

This results in the particular advantage that the retaining element can easily be secured on the clamping bolt, while simultaneously achieving positive retention.

In an advantageous further development, the bayonet fastener can be snap-locked in a variety of axial positions.

This offers an easy means of retaining tools of various thicknesses, with the axial snap-lock positions advantageously being matched to the various tool thicknesses defined by standardization.

In an advantageous embodiment, bayonet locking grooves, which for purposes of snap-locking are connected to a locking pin via an axial groove, are provided on the clamping bolt; the retaining element can easily be designed as a knurled knob from which the locking pin projects radially.

In an advantageous further development, the clamping device has a clamping fork, mounted rotatably about a fixed rotation axis, the free fork ends of which act on the displaceable stop to produce axial displacement.

In this embodiment, the displaceable stop, which preferably is arranged coaxially on the hollow spindle, is easily displaced axially by rotating the clamping fork.

In an alternative embodiment, the clamping device can have a clamping fork which is rotatably mounted at its two fork ends on a fixed rotation axis, and acts at its center region on the displaceable stop to produce axial displacement. In this embodiment, the retaining element is disengaged when the combined end of the clamping fork, opposite the two fork ends, is displaced towards the tool. In the aforesaid version, on the other hand, the retaining element is disengaged when the combined end of the clamping fork is displaced in the opposite direction.

Since improper operation cannot be absolutely ruled out, it must be expected that the power tool will be switched on even though the clamping device is still in the released position. In this case the clamping fork presses on the displaceable stop. When the drive is switched on, the clamping fork would then jam onto the displaceable stop.

To prevent this, in an advantageous further development roller elements are provided at the contact surface between clamping fork and displaceable stop to reduce friction.

To actuate the clamping fork, a clamping lever can be provided, by means of which the combined end of the clamping fork, facing away from the rotation axis, can be displaced axially.

Movement of the lever thus offers a simple way of producing displacement of the adjustable stop between the clamped and released settings.

In a first embodiment, the clamping lever can have, for this purpose, a long lever end which is rotatably mounted on the housing by means of a pin, and is connected to a short lever end by means of which a protruding end of the clamping fork can be displaced when the clamping lever is actuated.

In an alternative embodiment, the clamping lever is rotatably mounted on the housing by means of a cam, which acts on the combined end of the clamping fork via an axially movable pressure element to produce axial displacement.

In an advantageous further development, in the clamped position the clamping fork is additionally lifted away from the displaceable stop by a spring.

While in the first embodiment the clamping lever must be mounted inside the housing so that its short lever end can act on the clamping fork, in the second embodiment the clamping lever can be mounted outside the housing, since the clamping lever is actuated via the axially displaceable pressure element by the cam of the clamping lever.

Mounting the clamping lever outside the housing has the advantage that sealing problems related to sealing of the drive train from the outside are reduced.

In an advantageous further development, sealing of the drive train housing from the outside is improved by the fact that a seal is arranged between the fixed stop and the housing.

Advantageously, the clamping device is designed so that the axial displacement travel between the clamped position and the released position is at least great enough so that when the frictional engagement between the tool and the flanges is abolished in the released position, the stroke length of the positive retaining system of the retaining element can also be covered.

Since the total stroke length required is increased by an additional positive retaining system for the retaining element, the positive retainer preferably has the minimum possible stroke length; for this purpose, for example if end serrations are used, fine fluting can be provided, for example a 1:64 pitch.

In an advantageous further development, in the clamped position the clamping lever can be snap-locked at its free end on the housing.

This feature has the advantage of definitely preventing inadvertent actuation or release of the clamping lever.

In a further embodiment of the invention, the free end of the clamping lever is designed to be spaced outward away from the housing.

This feature has the advantage that in the clamped position, in which the clamping lever is folded against the housing, the clamping lever can be more easily grasped at its free end.

The clamping device ensures non-rotatable clamping of the tool in the clamped position by frictional engagement.

In an additional development, positive retention of the clamping bolt on the hollow spindle can be provided.

This ensures a non-rotatable connection between the hollow spindle and the clamping bolt.

This can easily be achieved by the fact that the clamping bolt has a polygonal section, for example in the shape of a triangle, that engages positively in the flange at the outer end of the hollow spindle.

It is self-evident that the features mentioned above and those yet to be explained below can be used not only in the particular combination indicated, but also in other combinations or in isolation, without leaving the context of the present invention.

Exemplary embodiments of the invention are depicted in the drawings and will be explained in more detail in the description that follows. In the drawings:

FIG. 1 shows a lengthwise section through the front region of a power tool in accordance with the invention, depicted schematically;

FIG. 2 shows a view of the clamping bolt with displaceable stop and clamping fork according to FIG. 1, seen from above after removal of the retaining element;

FIG. 3 shows a section along line III—III in FIG. 1;

Figure 4:
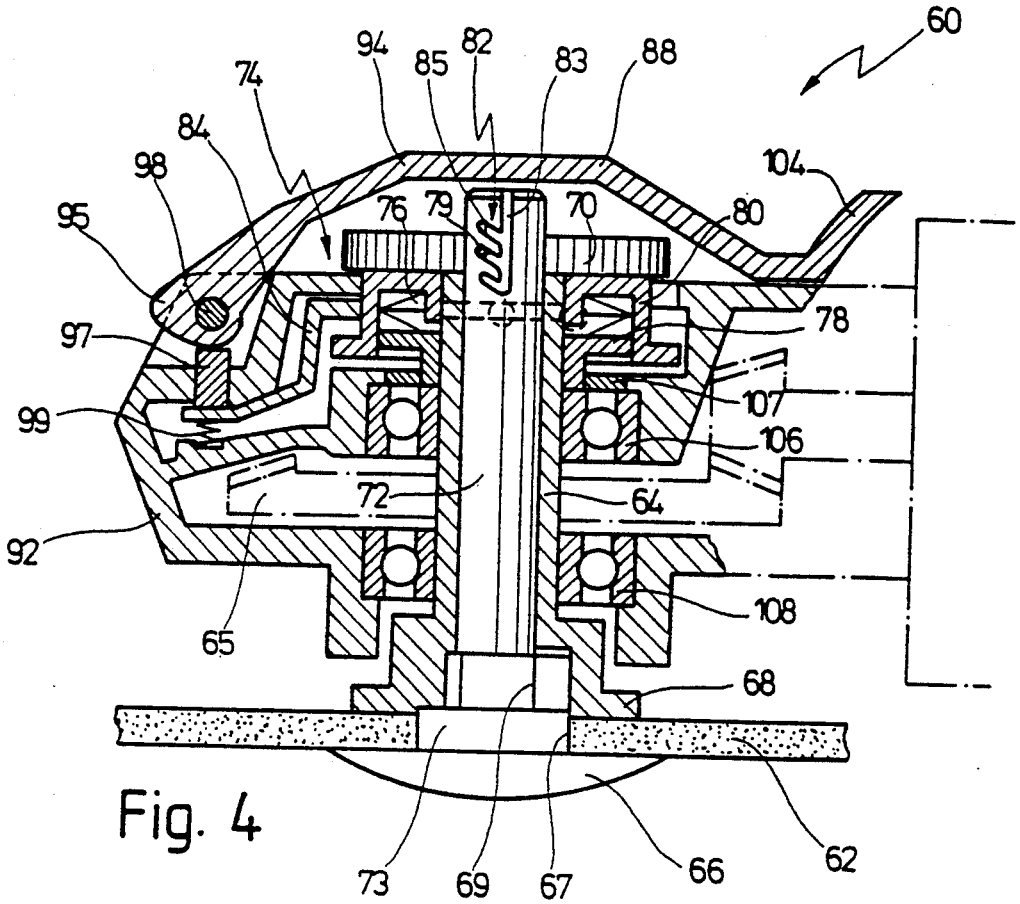
FIG. 4 shows a lengthwise section of a power tool in accordance with the invention, in an embodiment slightly different from FIG. 1.

As a first exemplary embodiment of a power tool in accordance with the invention, FIGS. 1 and 2 depict a right-angle grinder that is designated in its entirety with the numeral 10.

A hollow spindle 14 is non-rotatably attached to the power takeoff gear 15 of a right-angle drive train that is driven by an electric motor.

A tool 12, which is designed as a grinding disk, is clamped between two flanges 16, 18. While the inner flange 18 on the machine side is formed onto the end of the hollow spindle 14, the outer flange 16 is configured at the end of a clamping bolt 22 that is inserted through a central opening 17 of the tool 12.

The hollow spindle is mounted by means of two ball bearings 56, 58 arranged on either side of the power takeoff gear 15 of the right-angle drive train.

At its end facing away from the tool, the clamping bolt 22 has a threaded portion 32 that projects out from the hollow spindle 14, and onto which a retaining element 20 in the form of a tension nut can be screwed.

Arranged on the hollow spindle 14 is a fixed stop 28 in the form of an annular flange, which rests on the inner ring of the ball bearing 56 that faces away from the tool 12. Also arranged on the hollow spindle 14 is a displaceable stop 30 in the shape of a bushing. Retained between the displaceable stop 30 and the fixed stop 28 are spring elements 26 that are designed as disk springs and are externally enclosed by the displaceable stop 30. The spring force is approximately 1000–5000 N.

The displaceable stop 30 can be displaced axially with the aid of a clamping device 24 via a clamping fork 34 that can be actuated by a clamping lever 38. The bushing-shaped stop 30 has an external annular shoulder 31 against which the two free fork ends 36 of the clamping fork 34 can be pressed.

The clamping fork has an approximately U-shaped basic form, and is pivotally mounted on the housing 42 with two lateral pins 41. The two fork ends 36 are connected by a crosspiece 35, from the center of which protrudes a protruding part 37, by means of which the clamping fork 34 can be pivoted about the two lateral pins 41.

Since the pins 41 are arranged at an offset from the fork ends 36 towards the protruding part 37, the fork ends 36 project outward from the stationary rotation axis on the unit defined by the pins 41. If the protruding part 37 of the pivot fork is moved away from the tool, this therefore causes the fork ends 36 to pivot towards the annular shoulder 31 of the displaceable stop 30.

The clamping lever 38 is pivotally mounted, at a long lever end 46, in a recess of the housing 42 by means of a pin 48. Proceeding from the pin 48, the clamping lever 38 extends into a short lever end 44 at which a roller 50 is provided, which rests on the protruding part 37 of the clamping fork 34.

In the clamped position illustrated, the clamping lever 38 projects laterally out of the housing 42 with a bent section 43 of its long lever end 46, and after a short straight section, continues into an approximately trapezoidal section 45, which, in the clamped position illustrated, covers the clamping bolt 22 with the screwed-on retaining element 20 from outside. Lastly, the trapezoidal section 45 continues again into a straight section, at which the clamping lever 38 is locked onto the housing 42 by means of a catch 52. The clamping lever end 54 is bent laterally outward from the housing 42 to facilitate gripping.

In the clamped position illustrated, the displaceable stop 30 projects slightly outward from the housing surface, so that the retaining element 20 screwed onto the threaded portion 32 rests directly on the annular surface of the displaceable stop 30 and is thus acted on by the force of the spring elements 26.

Figure 6:
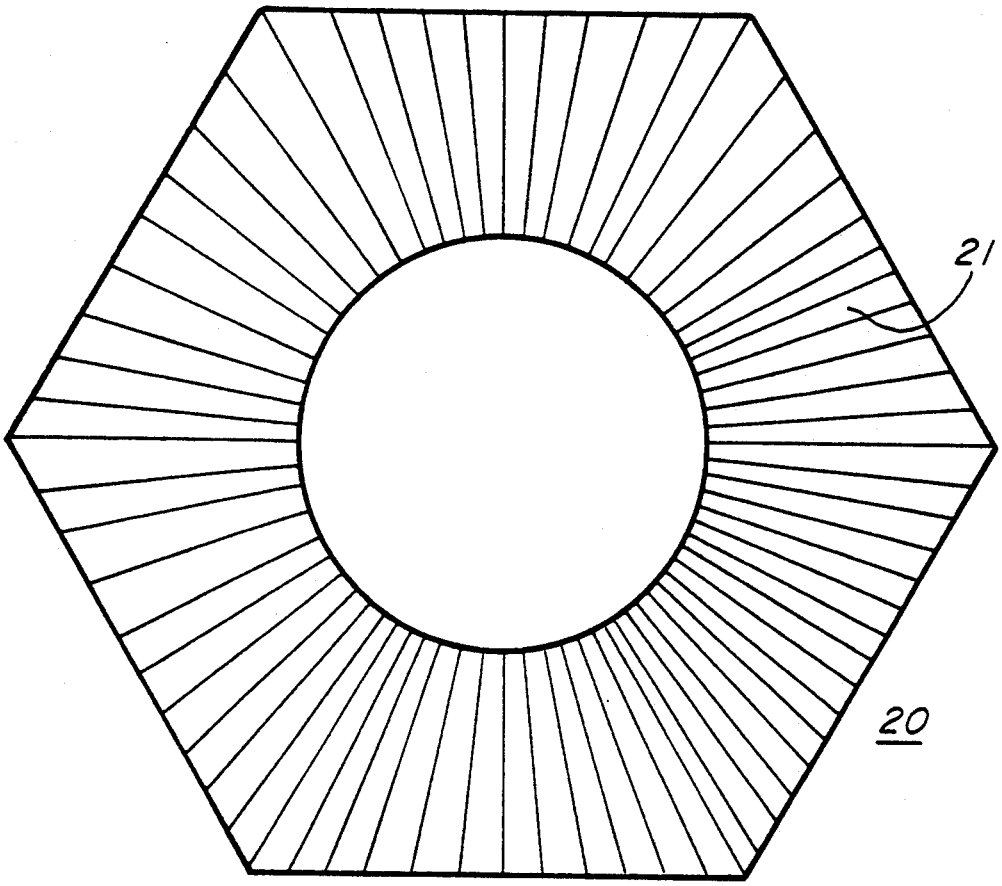
FIG. 6 shows a view of the retaining element 20 of FIG. 1, detailing serrations 21 on the mating surface thereof.

The two surfaces of the retaining element 20 and displaceable stop 30 that face one another have end serrations 21 as shown in FIG. 6, with which the retaining element 20 is positively on the displaceable stop 30.

In FIGS. 1 and 3, the clamping bolt 22 has on its outer region, towards the grinding disk, a polygonal section in the form of a triangle with three segments of a circle 25, connected to one another by straight segments 27. The polygonal section 19 engages positively in a correspondingly shaped recess on the flange 18 of the hollow spindle 14. Adjacent to the polygonal section 19 is a cylindrical section 23 of the clamping bolt 22, which engages in the opening 17 of the tool 12 and which is adjacent to the flange 16.

The procedure for changing a tool is as follows:

First the clamping lever 38 is grasped at its end 54 and pivoted forward away from the housing 42, overcoming the force of the catch lock 52. This causes the short lever end 44 with its roller 50 to move in a direction opposite to the tool 12, as a result of which the two fork ends 36 are pressed onto the annular shoulder 31 and the displaceable stop 30 is thus displaced towards the tool 12. As a result, the positive connection between the retaining element 20 and the displaceable stop 30 is abolished by the force of the spring elements 26, so that the nut can be unscrewed from the threaded portion 32 of the clamping bolt 22 without the aid of a tool.

The clamping bolt 22 can now be withdrawn from the hollow spindle 14 so that the tool 12 can be removed. After the clamping bolt 22 is inserted through its central opening, a new tool 12 is secured, and then, reversing the procedure, non-rotatably retained after the tension nut is screwed on.

In accordance with FIG. 1, to remove disk 12, clamping lever 38 must be pivoted about pin 48. The movement of lever 38 will push roller 50 against protruding part 37, which in turn will force fork 35 to displace stop 30 towards disk 12. Once displaced, stop 30 no longer applies pressure from spring 265 onto retaining element 20. Without any axial pressure on retaining element 20 from spring elements 26, retaining element 20, generally a serrated nut, is manually unscrewed from the threaded portion 32 of bolt 22. Once retaining element 20 no longer constrains bolt 22 with respect to hollow spindle 14, bolt 22 can be pushed out of hollow spindle 14 and central opening 17 of disk 12 with minimal effort and in a very simple manner, thereby minimizing chances of injury from inadvertent contact with disk 12.

To prevent leakage of lubricant from the drive train, a seal 57 is arranged between the fixed stop 28 and the housing seat of the ball bearing 56.

If improperly operated, the power tool could possibly be switched on while the clamping lever 38 is in the released position, i.e. is pivoted forward away from the housing. In this position the two fork ends 36 rest directly on the annular shoulder 31 of the displaceable stop 30.

To prevent jamming between the fork ends 36 and the annular shoulder 31, a rolling element 39 in the form of a roller is recessed in each fork end 36, substantially reducing friction and thus preventing jamming due to improper operation.

Figure 5:
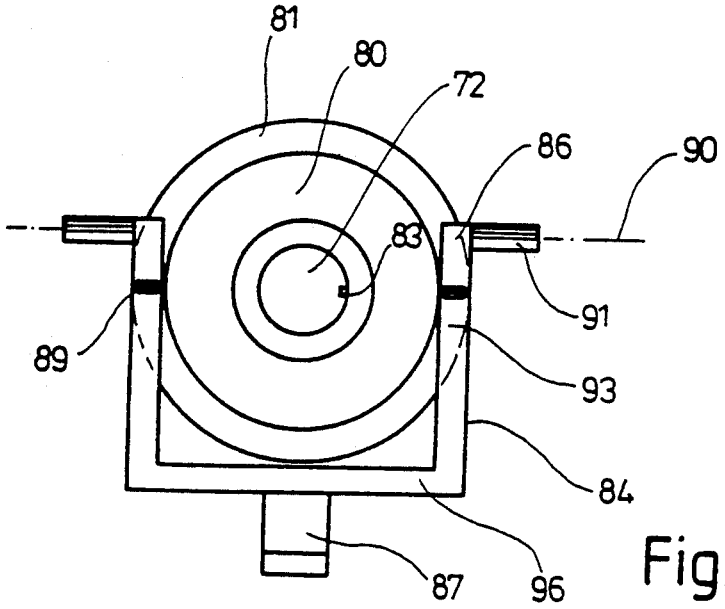
FIG. 5 shows a view of the clamping bolt according to FIG. 3 with displaceable stop and clamping fork, seen from above after removal of the retaining element.

A slightly different embodiment is depicted in FIGS. 4 and 5.

Here again, a hollow spindle 64 is mounted on two ball bearings 106, 108, and driven by the power takeoff gear 65 of a right-angle drive train. A grinding tool 62 is retained in a similar manner between a flange 68 at the outer end of the hollow spindle 64, and a flange 66 of a clamping bolt 72 inserted into the hollow spindle 64. The clamping bolt 72 is secured positively in a similar manner, with the aid of a polygonal section 69, to the flange 68 of the hollow spindle 64. To center the tool 62, adjacent to the polygonal section 69 of the clamping bolt 64 is a cylindrical section 73 which terminates in the flange 66.

The clamping bolt 72 projects, at its end facing away from the tool 62, out of the housing 92, and is fixed at its end by means of a bayonet fastener 82 with a retaining element 70.

As in the previous embodiment, there is arranged on the hollow spindle 64 a fixed stop 78 with which a displaceable stop 80 is associated. Provided between the fixed stop 78 and the displaceable stop 80 are spring elements 76 by which the bushing-shaped displaceable stop 80 is pressed outward against the retaining element 70.

In the clamped position illustrated, the retaining element 70 is therefore acted on in a direction opposite to the tool 62, as a result of which the tool 62 is non-rotatably clamped between the two flanges 66 and 68.

In order to change the tool 62, here again a clamping device 74 is provided, with which the displaceable stop 80 can be displaced by moving a clamping lever 88 towards the tool 62; this disengages the retaining element 70 from the force of the spring elements 76, So that it can be detached from the end of the clamping bolt 72 and the clamping bolt 72 can be withdrawn from the opening 67 of the tool 62.

In the embodiment according to FIG. 3, a bayonet fastener 82 is provided instead of a tension nut to secure the retaining element 70. The retaining element 70 is configured as a simple knurled knob on which a radial locking pin 79 is arranged. Provided at the end of the clamping bolt 72 is an axial groove 83, from which proceed a plurality of oblique locking grooves 85. In the released position, the locking pin 79 of the retaining element 70 can be inserted from the end of the clamping bolt 72 through the axial groove 83, and locked into place laterally in one of the locking grooves 85. If a tool of a different thickness needs to be secured, the locking pin 79 can be locked into place in a different locking groove 85.

In the clamped position illustrated, the locking pin 79 is retained at the end of a locking groove 85, so that the retaining element is retained in this position.

The clamping device 74 similarly has a clamping fork 84 with a U-shaped basic form, the two fork ends 86 of which are connected by a crosspiece 96 from which a protruding part 87 proceeds. The clamping fork 84 can be pivoted about a stationary rotation axis 90 on the unit by actuating the combined fork end 87.

In contrast to the embodiment described previously, the clamping fork 84 is mounted at its two fork ends 86 on the housing 92 by means of laterally projecting pins 91. The rotation axis of the clamping fork 84 thus passes through the two fork ends 86. The clamping fork further includes a crosspiece 96 connected with the fork ends 86 by arms 93. Arranged in the center region of these arms 93 are rolling elements 89 in the form of rollers, to reduce friction. The contact surface between the annular shoulder 81 of the displaceable stop 80 and the clamping fork 84 is thus formed by the rolling elements 89 in the center region of the arms 93.

The clamping lever 88 is pivotedly mounted outside the housing 92 by means of a pin 98. At this end, the clamping lever 88 is designed as a cam 95, which rests on a pressure element 97 that is axially displaceable in the housing 92. The end of the pressure element 97 rests on a protruding part 87 protruding from the crosspiece 96 of the clamping fork 84. The clamping fork 84 is pressed by a spring 99 against the pressure element 97, so that in the clamped position illustrated, the clamping fork 84 is lifted away from the displaceable stop 80.

The clamping lever 88 extends from the cam 95 with an approximately trapezoidal section 94 passing over the end of the clamping bolt 72 and the retaining element 70; its end rests on the housing 92 with a flat section, from which a bent section 104 projects outward.

If the clamping lever 88 is then pivoted forward away from the housing 92 and out of the clamped position illustrated, the pressure element 97 is displaced by the cam 95 towards the tool 62. This moves the clamping fork 84, at its combined end 87, towards the tool 62, as a result of which the displaceable stop 80 is displaced towards the tool 62.

This disengages the locking pin 79 of the retaining element 70, so that the locking pin can be moved through the locking groove 85 to the axial groove 83 of the bayonet fastener 82, and can be withdrawn from the clamping bolt 72 through the axial groove 83.

The tool 62 can now be changed in a known manner by pulling out the clamping bolt 72.

We claim:

1. Portable power tool comprising a housing for receiving a motor and an angled gear for driving a tool;

a hollow spindle driven by said angled gear;

two flanges for clamping said tool therebetween and arranged at one end of said hollow spindle, a first one of said flanges being provided on said hollow spindle;

a clamping bolt arranged within said hollow spindle and having a first end and a second end opposite said first end, said first end facing said tool and comprising a second one of said flanges;

a manually actuable clamping device including two stops arranged coaxially around said hollow spindle and including at least one elastic element for forcing said two stops into opposite directions, a first one of said stops being axially fixed and a second one of said stops being axially displaceable by means of said elastic element, said clamping device further including a clamping lever being operably connected to said axially displaceable stop for shifting said axially displaceable stop between a first axial retaining position for retaining said tool and a second axial releasing position for releasing said tool;

a retaining element provided on said second end of said clamping bolt, said retaining element being impinged by said axially displaceable stop for retaining said tool non-rotatably when said axially displaceable stop is in said first retaining position and said retaining element being released when said axially displaceable stop is in said second releasing position.

2. Power tool according to claim 1, wherein said axially displaceable stop is in the shape of a bushing, and wherein said elastic element is a compression spring element enclosed between said axially displaceable stop and said axially fixed stop.

3. Power tool according to claim 1, wherein said retaining element is positively retained when said axially displaceable stop is in said first retaining position.

4. Power tool according to claim 3, wherein said retaining element and said clamping bolt are provided with a bayonet fastener for positively connecting said retaining element and said clamping bolt.

5. Power tool according to claim 4, wherein said bayonet fastener includes a locking element provided on said retaining element and a bayonet guide provided on said clamping bolt, said bayonet guide having a plurality of locking positions for snap-locking of said locking element.

6. Power tool according to claim 5, wherein said bayonet guide comprises a plurality of locking grooves connected via an axial groove, and wherein said locking element is movable along said axial groove and snap-lockable in any one of said locking grooves.

7. Power tool according to claim 3, wherein said displaceable stop and said retaining element are both provided with end serrations coacting with each other for positively retaining said retaining element.

8. Power tool according to claim 1, wherein said retaining element is designed as a tension nut for screwing onto a threaded portion provided on said clamping bolt.

9. Power tool according to claim 1, wherein said clamping device includes a clamping fork mounted pivotally about a fixed axis, said clamping fork having two free fork ends, a crosspiece connecting said two free fork ends and a protruding part protruding outwardly from said crosspiece, said crosspiece being axially displaceable by said lever, thereby rotating said clamping fork around said fixed axis and thereby axially displacing said axially displaceable stop.

10. Power tool according to claim 9, wherein roller elements are provided on said clamping fork to reduce friction between said clamping fork and said axially displaceable stop.

11. Power tool according to claim 9, wherein said clamping lever is pivotable about a pin which is fixed on said housing, said pin dividing said clamping lever into a long lever part and a short lever part, said short lever part extending from said pin into an opposite direction of said long lever part, said short lever part acting on said protruding part of said clamping fork for pivoting said clamping fork about said fixed axis and thereby axially displacing said axially displaceable stop when said clamping lever is actuated.

12. Power tool according to claim 1, wherein said clamping device includes a clamping fork having two fork ends provided on two arms which are connected by a crosspiece, said two arms being rotatably mounted on a fixed rotation axis of said housing, said clamping fork further including a protruding part for rotation of said clamping fork and protruding from said crosspiece into a direction opposite said fork ends, said two arms engaging said axially displaceable stop to produce axial displacement thereof when said clamping fork is rotated.

13. Power tool according to claim 10, wherein said clamping lever has one end which is designed as a cam, said cam being rotatably mounted on said housing, and wherein a pressure part is provided between said cam of said clamping lever and said protruding part of said clamping fork, said pressure part axially displacing said protruding part when said pressure part is actuated by moving along said cam when said clamping lever is rotated.

14. Power tool according to claim 13, wherein in said first retaining position of said axially displaceable element the clamping fork is lifted away from said displaceable stop by means of a spring element provided between said protruding part of said clamping fork and between said housing.

15. Power tool according to claim 12, wherein roller elements are provided on said clamping fork to reduce friction between said clamping fork and said axially displaceable stop.

16. Power tool according to claim 1, wherein a seal element is arranged between said axially fixed stop and said housing for sealing said drive train against said housing.

17. Power tool according to claim 1, wherein said clamping lever has a free end which can be snap-locked on said housing when said axially displaceable stop is in said first retaining position.

18. Power tool according to claim 1, wherein said free end of said clamping lever is spaced outwardly away from said housing.

19. Power tool according to claim 1, wherein said clamping bolt is non-rotatably received in said hollow spindle and is positively connected to said hollow spindle.

20. Power tool according to claim 19, wherein said clamping bolt has a polygonal section positively engaging the first one of said flanges.

* * * * *